United States Patent [19]

Allenbaugh

[11] Patent Number: 4,891,926

[45] Date of Patent: Jan. 9, 1990

[54] WALK-THROUGH SCAFFOLDING CONSTRUCTION

[76] Inventor: Dwight Allenbaugh, 7520 Monroe St., Paramount, Calif. 90723

[21] Appl. No.: 295,983

[22] Filed: Jan. 12, 1989

[51] Int. Cl.[4] ..... E04G 1/14

[52] U.S. Cl. ..... 52/637; 52/696; 182/178

[58] Field of Search ..... 182/178, 179, 128; 52/638, 637, 696

[56] References Cited

U.S. PATENT DOCUMENTS

| | | | |
|---|---|---|---|
| 2,316,952 | 4/1943 | Halferty | 182/178 |
| 2,481,885 | 9/1949 | Simpson | 182/178 |
| 2,569,653 | 10/1951 | Boedecker | 182/178 |
| 3,245,188 | 4/1966 | Evans | 182/178 |
| 3,508,666 | 4/1970 | Schwengel | 182/178 |
| 3,527,320 | 9/1970 | Cunningham | 182/178 |
| 3,752,262 | 8/1973 | Helms | 182/178 |
| 4,430,839 | 2/1984 | Butters | 182/178 |

*Primary Examiner*—Reinaldo P. Machado
*Attorney, Agent, or Firm*—Charles H. Thomas

[57] ABSTRACT

An improved walk-through scaffolding frame is constructed of components which may be assembled together to form an erected frame and disassembled to pass through a narrow opening such as a manhole or some other narrow access opening to a larger enclosure. The improved walk-through scaffolding is constructed with a pair of generally triangular-shaped upright support members and a connecting crosspiece. The upright support members each define a single downwardly directed tubular leg as well as upwardly extending inner and outer support posts. The crosspiece includes downwardly directed connectors which telescopically engage both the inner and outer support posts of each of the pair of upright support members and an upwardly directed connector at its outer extremity for engaging a downwardly directed leg of another walk-through frame located thereabove. The upright support members and the crosspiece may be quickly and easily disassembled without tools to pass through very narrow manhole-type openings and reassembled without tools to erect scaffolding.

15 Claims, 3 Drawing Sheets

WALK-THROUGH SCAFFOLDING CONSTRUCTION

BACKGROUND OF THE INVENTION

1. Field of the Invention

The present invention relates to an improved construction of walk-through scaffolding.

2. Description of the Prior Art

In many industrial and construction environments scaffolding is required in locations which are accessible only through small openings, such as manholes. For example, the access openings to enter many tanks in refineries are only eighteen inches in diameter. Nevertheless, there are often tasks which must be performed in such tanks which require the use of scaffolding. For example, the interior walls of such tanks must be sandblasted, cleaned and welded at times. Although the access openings to such tanks are often extremely narrow, the tanks themselves encompass large volumes of space which require the assembly of a multiplicity of scaffolding members. The use of scaffolding is particular advantageous where lateral mobility is required. That is, the use of scaffolding allows workers to move laterally to perform necessary tasks, whereas lateral mobility is not possible when working from ladders.

At present, the types of scaffolding which are employed in locations accessible only through narrow manholes are different forms of scaffolding construction known as systems scaffolding. Systems scaffolding includes both modular scaffolding and tube and clamp scaffolding. In tube and clamp scaffolding the scaffolding framework must be built up from linear lengths of scaffolding pipe which are typically joined together by various types of locking devices and clamps. The assembly of such scaffolding within refinery tanks and other locations having limited access openings requires tools for tightening the clamps and considerable manual manipulation to properly position and tighten each clamp at each joint. Easily fifty to seventy five percent of the total time spent in accomplishing a project within such tanks, such as sandblasting, cleaning and welding, is consumed in the erection and disassembly of the scaffolding used for these tasks.

A different type of scaffolding is employed in other environments where no narrow access manholes are involved. A very popular type of scaffolding which is widely utilized in locations without narrow access opening limitations is a type of scaffolding known as frame scaffolding, one popular form of which is termed walk-through scaffolding. The individual frames of walk-through frame scaffolding, hereinafter referred to as walk-through scaffolding, are of a generally arch-like configuration formed by outer, generally vertical legs joined together at their tops by a crosspiece and including braces which normally extend upwardly and inwardly to interior locations on the crosspiece from the outer, vertically oriented pipes forming the legs. The braces, the vertically oriented pipes, and the crosspieces of each frame are all normally welded together and each walk-through frame is positioned as a rigid unit. The frames are disposed in vertical planes and are joined together by laterally extending crossbraces which extend between the laterally separated and generally vertically oriented scaffolding frames. Successive levels of the frames are vertically stacked, one atop another, to the height necessary to accommodate workers at the elevations above grade at which the tasks are to be performed.

Walk-through scaffolding is widely used in the construction industry and is erected around a building under construction to allow construction workers to reach the upper levels of the building. Walk-through scaffolding is also used in many industrial maintenance repair operations where tasks are to be performed at elevations above the surface and where there significant space restrictions do not exist.

Walk-through scaffolding is far easier and quicker to assemble and disassemble than is either modular or tube and clamp scaffolding. The large walk-through scaffolding frame sections can be interconnected by crossbraces. The ends of the crossbraces terminate in locking devices which require no tools for engagement to achieve locking interconnection. Typical locking devices of this type are a plow bolt with a wing nut, a snap-on latch, and drop lock and flip lock connectors. Since no tools are required for the assembly and disassembly of walk-through scaffolding, such scaffolding can be put into place and disassembled relatively quickly.

The assembly and disassembly of modular and tube and clamp scaffolding, on the other hand, requires the interconnection of scaffold members by means of clamps, such as swivel clamps and right angle clamps, which require bolts to be tightened with wrenches or other tools at each and every joint throughout the scaffolding structure. The laborious process of tightening or loosening one or more bolts at each interconnection of modular linear scaffolding members greatly lengthens both the time of assembly and the time of disassembly. As a result, the cost of erecting and disassembling modular scaffolding is increased enormously. Nevertheless, modular scaffolding has heretofore been the only practical, commercially available type of scaffolding which could be used within enclosures accessible only through narrow manholes or access openings, since the large frame elements of walk-through scaffolding cannot pass through such openings.

SUMMARY OF THE INVENTION

The present invention is an improved form of walk-through scaffolding in which the walk-through frames are not constructed as bulky arch-like units of permanently connected lengths of steel tubing, but instead are each formed by a pair of upright support members which are connected together by a removable crosspiece. Unlike modular scaffolding, however, no tools are required to assemble together the component elements of either the walk-through frames or the crossbraces which interconnect those frames.

In one broad aspect the present invention may be considered to be a modular walk-through frame for scaffolding comprising a pair of upright support member spaced laterally apart in mirror image arrangement each having a lower extremity terminating in a tubular leg and an upper extremity terminating in inner and outer tubular support posts, and a removable crosspiece extending between the upright support members for joining them together and having downwardly directed means for engaging the inner support posts and downwardly directed means for engaging the outer support posts and having upwardly directed means to engage tubular legs of other upright support members of another modular walk-through frame positioned thereabove.

In another broad aspect the present invention may be considered to be an improvement in a walk-through scaffolding frame adapted for modular interconnection with other identical walk-through scaffolding frames positioned above and below. The improvement of the invention resides in the fact that each walk-through scaffolding frame is comprised of a pair of upright support members and a removable connecting crosspiece. All of these elements are completely separable from each other. Each upright support member has a downwardly directed tubular leg and a pair of laterally spaced upwardly directed tubular support posts. The crosspiece includes downwardly directed means for telescopically engaging the upright support posts and upwardly directed means for telescopically engaging legs of support members of another of the scaffolding frames located thereabove.

Each frame of the walk-through scaffolding of the invention is not constructed as a permanently formed unit, as in the case of conventional walk-through scaffolding. Rather, each frame of the walk-through scaffolding of the invention is constructed with a pair of upright support members, each of which includes a linear, rigid vertically oriented pipe which terminates in the tubular leg of the upright support member at its lower extremity and in the outer tubular connecting post at its upper extremity. Another pipe forming a brace member is rigidly secured at its own lower extremity to the vertically oriented pipe and extends upwardly and inwardly and terminates in the inner connecting post at its upper extremity. The brace may also be a linear section of pipe which extends from the vertically disposed pipe at an angle extending upwardly and inwardly therefrom, or it may be a length of pipe that curves upwardly and inwardly. In either event there are typically several transverse stabilizing struts in each upright support section. The stabilizing struts are rigidly connected to the vertically oriented pipe and the brace pipe between the leg and the inner and outer connecting posts. The stabilizing struts are welded to the vertically oriented pipes and to the upwardly and inwardly extending brace pipe so that the inner and outer support posts or connecting posts of each upright support member are rigidly stabilized relative to each other.

In the preferred embodiment the downwardly directed means on the crosspiece for engaging the outer support posts and the upwardly directed means for engaging the tubular legs of another walk-through frame located thereabove are located at the opposite ends of linear sections of pipe that are welded perpendicular to a transverse bar member that extends between all of the connecting posts. The linear pipe sections at the ends of the transverse bar member form upwardly and downwardly directed tubular sockets in which hollow studs are mounted. The studs in the upwardly directed tubular sockets are designed to extend telescopically into the legs of another modular walk-through scaffold section assembly positioned thereabove, while the studs that extend from the downwardly directed sockets are designed to extend telescopically into the outer connecting post openings at the upper ends of the vertically oriented pipes of the upright support members. The studs are preferably hollow and are typically formed as tubular sections of pipe of a diameter reduced from the diameter of the sockets and ar welded to the sockets.

Between the sockets of the crosspiece the downwardly directed members for connection to the inner connecting posts of the upright support members are preferably comprised of tubular sleeves, adapted to receive the inner connecting posts telescopically therewithin. The tubular sleeves are welded to extend perpendicularly outwardly from the transverse bar member of the crosspiece, and may be stabilized by a transversely extending brace or strut member.

The upwardly and downwardly extending telescoping studs are preferably provided with some form of detent or catch members to releasably hold the crosspiece in engagement with the vertically disposed linear sections of the upright support members at both the outer connecting posts of the same walk-through frame and at the leg of the walk-through frame positioned thereabove. The releasably detent devices may be conventional spring retainers, which are currently widely used as releasable connectors in the scaffolding industry. Such spring retainers are each formed by a strip of metal, bent into a generally V-shaped configuration and having outwardly directed protuberances or latching lugs thereon. These latching lugs extend through diametrically opposed openings in the hollow studs and into diametrically opposed openings in the tubular pipe walls of the vertically disposed pipe of the upright support.

The upright support members of the improved walk-through scaffolding frame can be easily assembled and disassembled from the crosspiece without the use of any tools whatsoever. As a consequence, the upright support members, as well as the crosspiece, will easily pass through very narrow manhole-type openings It is therefore possible to pass the three disassembled elements of each walk-through frame separately through a narrow manhole and then assemble the three elements in a matter of seconds.

No tools or clamps are necessary to assemble the walk-through frames of the invention. Nevertheless, due to the telescoping engagement of the crosspiece at both the inner and outer tubular connecting posts, the walk-through frame of the invention is very sturdy and will not twist or rack when subjected to torsional forces.

The improved scaffolding frame construction of the invention allows a great deal of time to be saved in erecting scaffolding within an enclosure that is accessible only through a narrow manhole or other type of port. Using the improved walk-through scaffolding frame construction of the invention the scaffolding can be easily passed through an eighteen inch diameter manhole of a refinery tank and erected and disassembled in approximately half the time that is required with conventional modular scaffolding.

The invention may be described with greater clarity and particularity with reference to the accompanying drawings.

DESCRIPTION OF THE EMBODIMENTS

Figure 1:
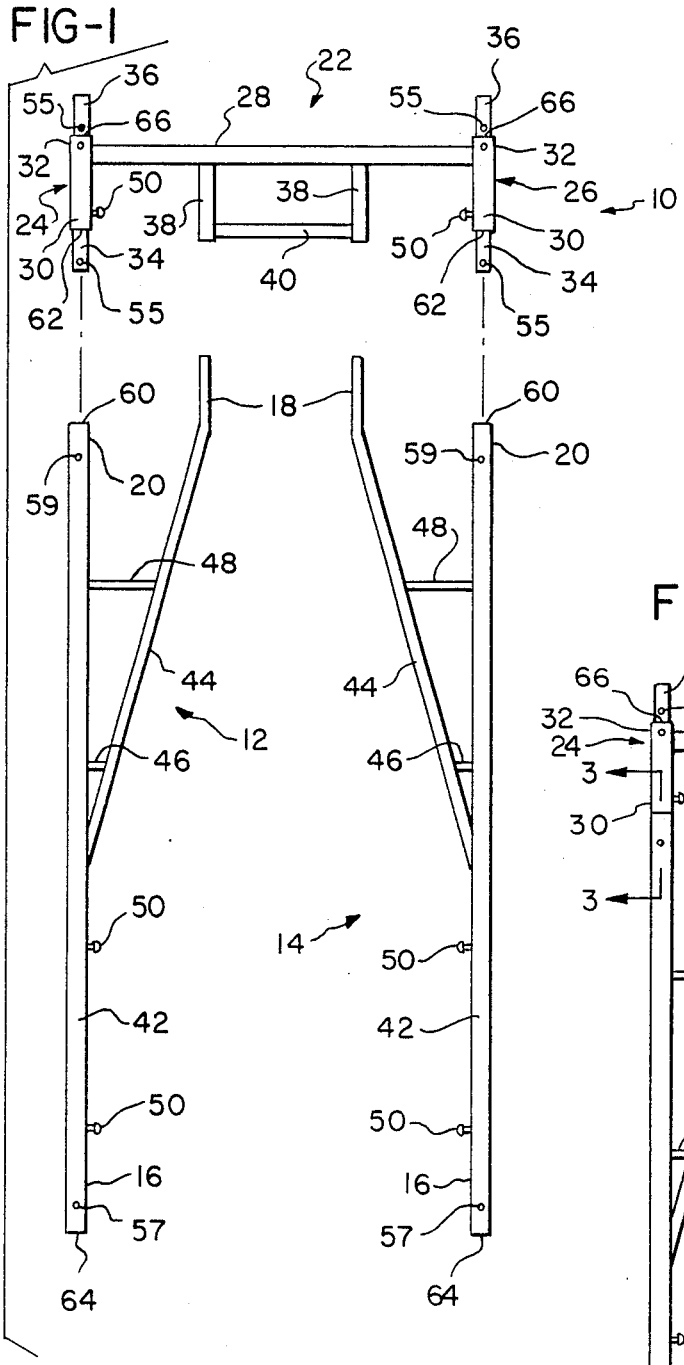
FIG. 1 illustrates one preferred embodiment of the improved walk-through scaffolding frame of the invention disassembled into its several components.

FIG. 1 illustrates a walk-through scaffolding frame indicated generally at 10 and separated into its component members. The scaffolding frame 10 is comprised of a pair of upright support members 12 and 14 spaced laterally apart in mirror image arrangement and each having a lower extremity terminating in a tubular leg 16 and each having an upper extremity terminating in an inner upright tubular support post 18 and an outer upright tubular support post 20. The walk-through scaffolding frame 10 is also comprised of a crosspiece 22 extending between the upright support members 12 and 14 for joining the upright support members 12 and 14 together.

The crosspiece 22 has a pair of vertically disposed sections of pipe 24 and 26 welded parallel to each other and perpendicular to a transverse tubular bar member 28. The pipe sections 24 and 26 may be formed of one and five eighths inch diameter steel tubing and may be eight inches in length. The pipe sections 24 and 26 are welded to the end of the transverse crossbar 28 and are located a distance thirty six inches apart, center to center.

The pipe sections 24 and 26 form downwardly directed tubular sockets 30 and upwardly directed tubular sockets 32. Hollow tubular studs 34 extend downwardly from the sockets 30 of the pipe sections 24 and 26, while identical hollow tubular studs 36 extend upwardly from the sockets 32. The studs 34 in the downwardly directed tubular sockets 30 and the studs 36 in the upwardly directed tubular sockets 32 are formed by opposite ends of common fifteen inch lengths of vertically oriented one and three eighth inch steel pipe sections which reside telescopically within the pipe sections 24 and 26 and which protrude longitudinally three and one half inches from both ends thereof.

The crosspiece 22 also includes a pair of downwardly depending tubular coupling sleeves 38 which are formed of six and one half inch lengths of one and one quarter inch diameter steel tubing and are adapted to receive the inner connecting posts 18 therewithin. The tubular sleeves 38 are welded at their uppermost ends to the side wall of the transverse bar member 28 eleven and one quarter inches from the centerlines of the pipe sections 24 and 26 and thirteen and one half inches apart. The sleeves 38 are cross-connected near their lowermost ends by a 1.050 inch diameter tubular stabilizing strut or brace 40.

The tubular leg 16 and the outer upright support 20 of each of the upright support members 12 and 14 are both formed by the opposite ends of a single vertically disposed seventy two inch length of linear pipe 42 and are both formed with the same cross section, since the pipe 42 is preferably of one and five eighths inch diameter tubular steel throughout. Each of the upright support members 12 and 14 is further comprised of a brace 44 formed of 1.050 inch diameter steel tubing. Each brace 44 extends at an angle upwardly and inwardly from the vertically disposed length of linear pipe 42 to which it is joined and terminates at an inner support post 18. The inner support posts 18 extend upwardly a distance of six and one half inches further than the outer support posts 20. Each of the braces 44 is held at a rigid orientation to the vertically oriented pipe 42 to which it is welded by transverse stabilizing struts 46 and 48 which are located sixteen inches apart from each other. The struts 46 and 48 are all formed of one half inch round steel bar stock.

The upwardly extending sockets 32 protrude above the transverse crossbar 28 a distance of three quarters of an inch. The pipe sections 24 and 26 are each eight inches in overall length and have inwardly extending one half inch round rivets 50 located six and one half inches from their uppermost extremities. The vertically oriented lengths of pipe 42 likewise have inwardly extending one half inch round head rivets 50. The rivets 50 are employed for the purpose of securing crossbraces which join successive scaffolding frames 10 in a conventional manner, once the component elements of successive scaffolding frames 10 have been assembled together.

Figure 3:
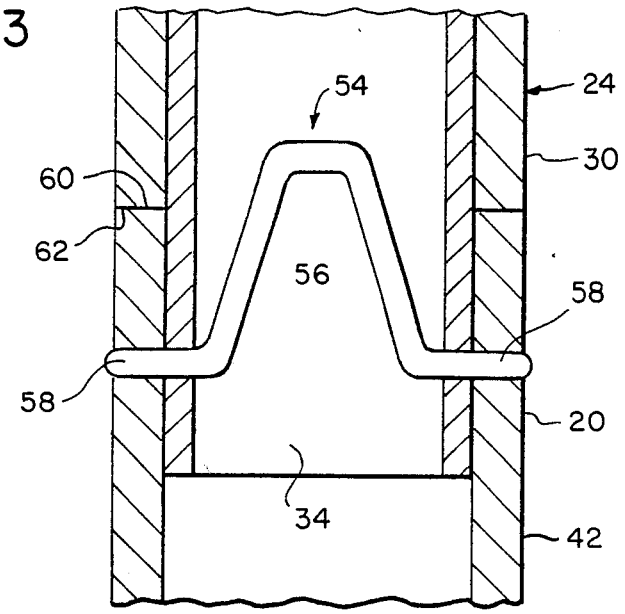
FIG. 3 is a sectional detail taken along the lines 3—3 of FIG. 2 and showing the manner of releasable latching of the scaffolding frame components together utilizing a spring clip.

The studs 34 and 36 each have diametrically opposed openings 55 therein, and the tubular legs 16 and the outer upright support posts 20 are also formed with diametrically opposed openings 57 and 59, respectively. As illustrated in FIG. 3, generally V-shaped spring retainer clips 54 are disposed within each of the studs 34 and 36. The spring retainer clips 54 have diverging legs which terminate in outwardly extending lugs 58. The lugs 58 project outwardly through the opposed openings 55 in the studs 34 and 36 and into the opposed openings 57 in the tubular legs 16 and into the opposed openings 59 in the outer upright support posts 20.

To utilize walk-through scaffolding having a number of frames 10, the three component elements of each frame, namely the upright support members 12 and 14 and the crosspiece 22, are initially disassembled as depicted in FIG. 1. It can be seen that each of these components can easily be handed through a narrow manhole opening only eighteen inches in diameter. Once the several components of the scaffolding frame 10 have been handed through the manhole opening and are inside of an enclosure within which the scaffolding is to be assembled, the components of the frame 10 are positioned relative to each other as depicted in FIG. 1. The crosspiece 22 is moved toward the upright supports 12 and 14 such that the inner tubular support posts 18 are in longitudinal alignment with the sleeves 38 and the outer tubular support posts 20 ar in longitudinal alignment with the studs 34. Since the inner support posts 18 extend beyond the outer support posts 20 in a vertical direction, the sleeves 38 will telescopically engage the inner support posts 18 prior to engagement of the studs 34 in the outer support posts 20, and will guide the studs 34 and the outer support posts 20 into engagement.

Figure 2:
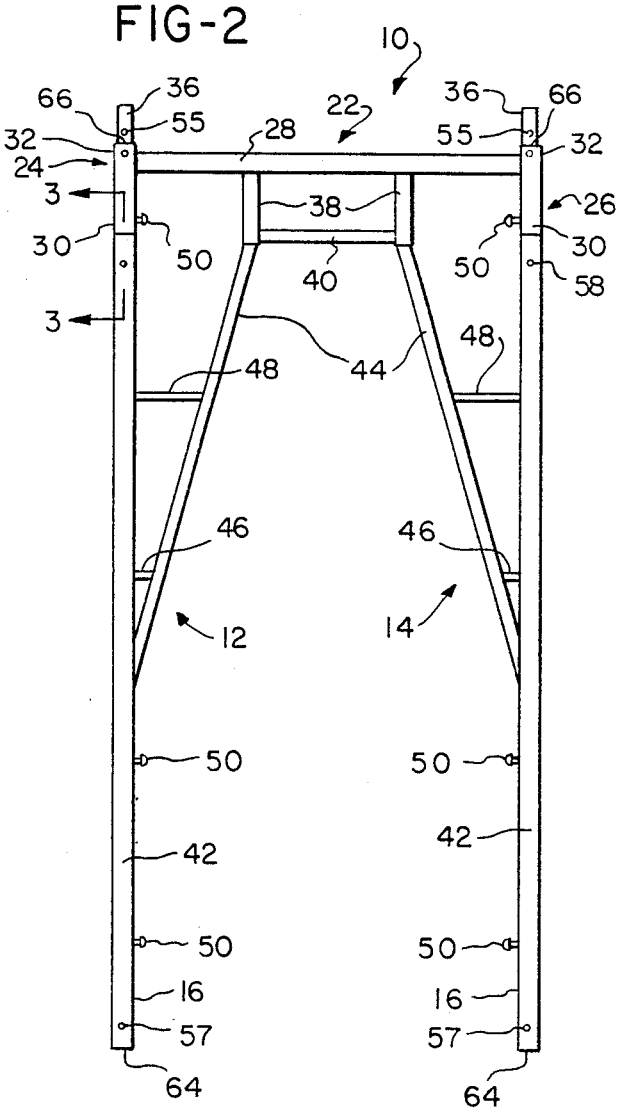
FIG. 2 illustrates the scaffolding frame components of FIG. 1 assembled together.

As the studs 34 telescopically engage the outer support posts 20 the legs 56 of the spring clips 54 are resiliently deflected and the projecting lugs 58 are pressed inwardly to allow the studs 34 to seat completely within the outer support posts 20. The openings 55 in the studs 34 and 36 and the openings 59 in the outer support posts 20 are positioned such that they reside in coaxial alignment as the ends 60 of the outer tubular support posts 20 meet the ends 62 of the pipe sections 24 or 26 in abutment. When the ends 60 and 62 meet in face to face contact, the openings 55 in the studs 34 are in coaxial alignment with the openings 59 in the tubular upright outer support posts 20. The detent lugs 58 of the spring retainer clips 54 are thereupon forced outwardly into through the openings 55 in the studs 34 and into the openings 59 in the pipes 42 due to the resilient deflection of the legs 56 of the spring retainers 54. The lugs 58 thereupon releasably latch the studs 34 to the outer upright tubular support posts 20. The walk-through frame 10 is then in a fully assembled condition as depicted in FIG. 2, and can be cross connected to other assembled modular walk-through frames 10 in the conventional manner employed to interconnect conventional walk-through scaffolding frames.

Since the vertically oriented linear pipes 42 are of uniform cross section throughout, the upwardly projecting hollow studs 36 will fit telescopically into the legs 16 of a walk-through scaffolding frame 10 positioned thereabove. The lower ends 64 of the legs 16 of one frame 10 stacked atop another will rest atop the upper ends 66 of the pipe sections 24 and 26 of the frame located therebeneath. The diametrically opposed openings 57 in the legs 16 and the diametrically opposed openings 55 in the studs 36 are located such that they are in coaxial alignment when the lower ends 64 of the legs 16 contact the upper ends 66 of the pipe sections 24 and 26. The resiliently deflected outwardly projecting lugs 58 of the spring retainers 54 thereupon spring outwardly to project into the openings 57 in the legs 16 through the openings 55 in the studs 36. The legs 16 are joined to the upwardly directed studs 36 in the same manner as the spring clips 54 of the studs 34 join the crosspiece 22 to the upright support members 12 and 14 of the frame 10 located therebeneath. The assembled walk-through frames 10 can thereby be interconnected in modular fashion relative to each other in the erection of scaffolding in the manner used to assemble conventional walk-through scaffolding frames.

Once the scaffolding frames 10 have been erected and linked together with crossbracing in an overall scaffolding structure, the normal operations performed using scaffolding, such as sandblasting, cleaning walls, welding, and painting may be performed. When these operations have been completed the scaffolding frames 10 are disconnected from each other in the conventional manner. After the frames 10 have been separated from each other, each frame is disassembled into its component elements by merely depressing the latching lugs 58 of the spring clip retainers 54 radially inwardly and out of engagement with the openings 59. The crosspiece 22 is then pulled away from the upright support members 12 and 14. This separates the scaffolding frame 10 into its modular components, which can then be separately passed back out through a narrow manhole opening.

Figure 4:
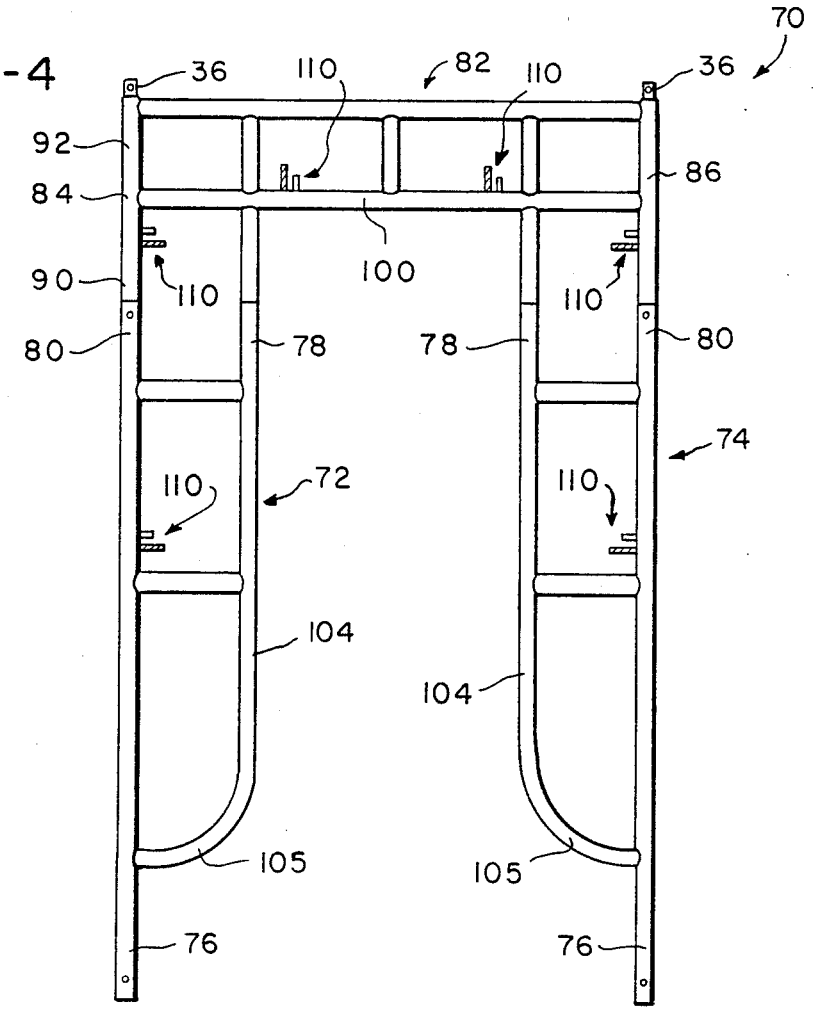
FIG. 4 illustrates an alternative embodiment of a walk-through scaffolding frame according to the invention.

The frame 10 depicted in FIG. 1 is but one embodiment of a walk-through scaffolding frame constructed in accordance with the present invention. FIG. 4 illustrates an alternative embodiment which likewise employs the unique walk-through scaffolding frame construction of the invention. FIG. 4 illustrates a walk-through scaffolding frame 70 which employs upright support sections 72 and 74 and a connecting crosspiece 82. The upright support sections 72 and 74 are all completely separable from each other in the same manner as the components 12, 14 and 22 of the frame 10. Each of the upright support members 72 and 74 has a downwardly directed tubular leg 76 and a pair of laterally spaced upwardly directed inner support posts 78 and outer support posts 80. The crosspiece 82 includes a transverse cross member 100, to the ends of which pipe sections 84 and 86 are welded together. The pipe sections 84 and 86 include downwardly projecting sockets 90 with tubular studs 34 therewithin and upwardly projecting sockets 92 with tubular studs 36 therewithin. The braces 104 of the upright support members 72 and 74 differ from the braces 44 in that they are formed of lengths of tubular pipe which extend parallel to the vertically oriented pipes 80 at their upper extremities, and curve around and extend outwardly at their lower extremities where they are welded to the vertically oriented pipes 80. The scaffold frame 70 employs drop lock fastening elements 110, rather than the rivets 50 to accommodate crossbraces having drop lock end connectors.

Figure 5:
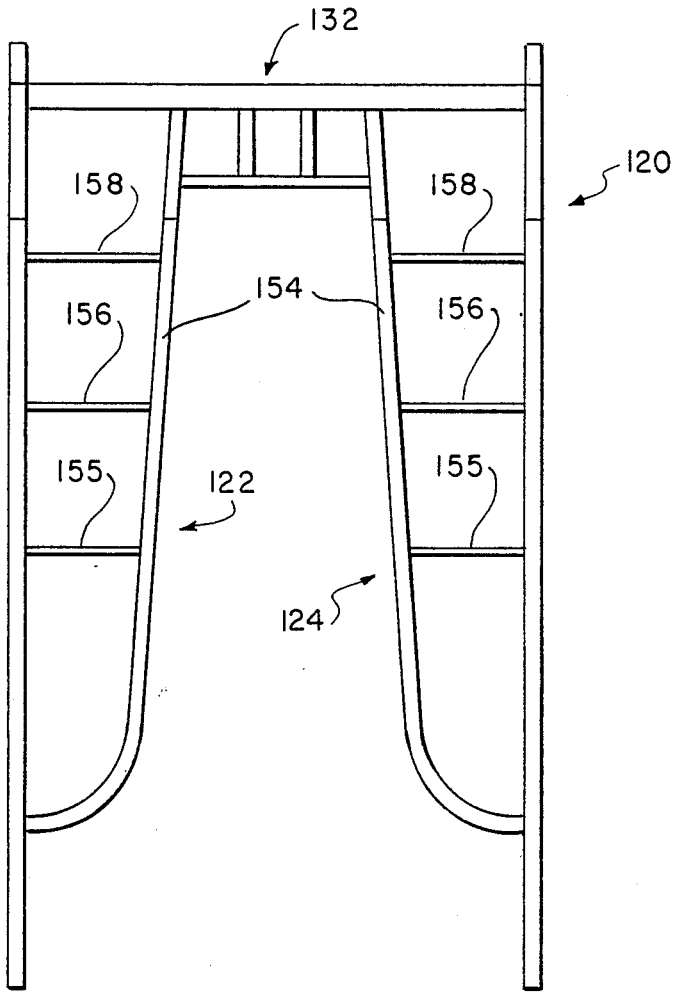
FIG. 5 illustrates a further alternative embodiment of the improved walk-through scaffolding frame of the invention.

FIG. 5 illustrates another embodiment 120 of the unique walk-through construction frame of the invention having upright support posts 122 and 124 and a crosspiece 132. The braces 154 and the stabilizing struts 155, 156 and 158 form still another variation in configuration of the components of the walk-through scaffolding of the invention. Numerous other different embodiments of walk-through scaffolding frames may likewise be employed without departing from the scope of the invention.

It is to be understood that other variations and modifications of the invention may become readily apparent to those familiar with scaffolding construction and use. Accordingly, the scope of the invention should not be construed as limited to the specific embodiments depicted and described above, but rather is defined in the claims appended hereto.

I claim:

1. A modular walk-through frame for scaffolding comprising: a pair of upright support members spaced laterally apart in mirror image arrangement each having a lower extremity terminating in a tubular leg and each having an upper extremity terminating in inner and outer upright tubular support posts, and a removable crosspiece extending between said upright support members for joining them together and having downwardly directed means for engaging said inner support posts and downwardly directed means for engaging said outer support posts and having upwardly directed means to engage tubular legs of other upright support members of another modular walk-through frame positioned thereabove.

2. A modular walk-through frame according to claim 1 further characterized in that said tubular leg and said outer upright support post of each upright support member are both formed by opposite ends of a single vertically disposed length of linear pipe and are both formed with the same cross section.

3. A modular walk-through frame according to claim 2 further characterized in that said downwardly directed means on said crosspiece for engaging said outer support posts and said upwardly directed means for engaging said tubular legs are located at the opposite ends of sections of pipe at the extremities of said crosspiece.

4. A modular walk-through frame according to claim 3 wherein said upwardly directed means for engaging said tubular legs and said downwardly directed means for engaging said outer support posts are all formed by studs which fix telescopically within said tubular legs and telescopically within said outer support posts.

5. A modular walk-through frame according to claim 4 wherein said studs are formed of hollow pipe sections with diametrically opposed lateral openings therein and said tubular legs and said outer upright support posts ar all formed with diametrically opposed lateral openings therein and further comprising spring retainers within each of said studs for engaging said opposed lateral openings in said tubular legs and in said outer upright support posts through said opposed lateral openings of said studs.

6. A modular walk-through frame according to claim 4 wherein said downwardly directed means for engaging said inner support posts are comprised of sleeves adapted to telescopically fit over and receive said inner support posts.

7. A modular walk-through frame according to claim 6 wherein each of said upright support members is comprised of a brace extending upwardly and inwardly from said vertically disposed length of linear pipe and said braces terminate at said inner support posts.

8. An improved modular walk-through scaffold section assembly comprising a pair of upright support members laterally spaced from each other and each terminating at its lower extremity in a single vertically disposed tubular leg and at its upper extremity in a pair of laterally spaced, upright inner and outer tubular connecting posts, and a removable crosspiece having a transverse bar member extending between all of said connecting posts, downwardly depending tubular coupling members rigidly joined to said transverse bar member and telescopically engageable with said connecting posts of said upright support members, and upwardly extending tubular coupling members adapted for telescopic engagement with a leg of another modular, walk-through scaffold section assembly located vertically thereabove.

9. A walk-through scaffold section assembly according to claim 8 wherein each of said upright support members is comprised of a vertically oriented linear rigid pipe which terminates in said tubular leg at its lower extremity and in said outer tubular connecting post at its upper extremity, a pipe forming a brace which is rigidly secured at its own lower extremity to said vertically oriented pipe and which extends upwardly and inwardly and terminates in said inner connecting post at its upper extremity, and transversely extending stabilizing strut means rigidly connected to said vertically oriented pipe and to said brace pipe between said leg and said inner and outer connecting posts.

10. A walk-through scaffold section assembly according to claim 9 wherein said downwardly depending tubular coupling members are comprised of tubular sleeves adapted to receive said inner connecting posts therewithin and downwardly directed tubular sockets in which studs are mounted to extend telescopically into said outer connecting posts and said upwardly extending tubular coupling members include upwardly directed tubular sockets in which studs are mounted to extend telescopically into the legs of another modular walk-through scaffold section assembly positioned thereabove.

11. A walk-through scaffold section assembly according to claim 10 wherein said studs in said downwardly directed tubular sockets and said studs in said upwardly directed tubular sockets are formed by opposite ends of common lengths of vertically oriented pipe permanently secured within said sockets.

12. A walk-through scaffold section assembly according to claim 11 further comprising spring retainers located within each of said studs and engageable with said tubular legs and with said outer tubular connecting posts.

13. In walk-through scaffolding frame adapted for modular interconnection with other identical walk-through scaffolding frames positioned above and below, the improvement wherein said frame is comprised of a pair of upright support members and a connecting crosspiece, all completely separable from each other and wherein each of said upright support members has a downwardly directed tubular leg and a pair of laterally spaced, upwardly directed tubular support posts, and said crosspiece includes downwardly directed means for telescopically engaging said upright support posts and upwardly directed means for telescopically engaging legs of support members of another of said scaffolding frames located thereabove.

14. A walk-through scaffolding frame according to claim 13 wherein each of said upright support members is comprised of a length of linear, vertically oriented pipe extending from said tubular leg to an outermost of said tubular support posts in said pair of support posts and a brace member extending upwardly and inwardly from said vertically oriented pipe at a junction therewith located between said tubular leg and said outermost support post thereof and terminating at its upper extremity in an innermost of said support posts in said pair of support posts.

15. A walk-through scaffolding frame according to claim 14 wherein said brace member is inclined at an angle upwardly and inwardly from said vertically oriented pipe from which it extends.

* * * * *